US008569604B1

(12) United States Patent
Sikra

(10) Patent No.: US 8,569,604 B1
(45) Date of Patent: Oct. 29, 2013

(54) CYMBAL ADJUSTMENT AND POSITIONING FOR HI HAT

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 111 days.

(21) Appl. No.: 13/200,054

(22) Filed: Sep. 19, 2011

(51) Int. Cl.
*G10D 13/02* (2006.01)

(52) U.S. Cl.
USPC ..... 84/422.4

(58) Field of Classification Search
USPC ..... 84/422.1, 422.3, 422.2
See application file for complete search history.

(56) References Cited

U.S. PATENT DOCUMENTS

2012/0318119 A1* 12/2012 Coady ..... 84/422.3

* cited by examiner

*Primary Examiner* — Kimberly Lockett
(74) *Attorney, Agent, or Firm* — William W. Haefliger

(57) ABSTRACT

An adjustable assembly for cymbals adjustment, comprising an actuator rod movable up and down, a tubular adjuster passing the rod, and connectible to the rod after adjustment lengthwise of the rod, a tube passing the rod and having connection to the adjuster, the tube carrying the upper cymbals, and clutch means including a threaded body having thread connection to the tube, and rotatable thereon to be advanced on the tube to lock to the adjuster, thereby releasably locking the tube to the adjuster.

7 Claims, 5 Drawing Sheets

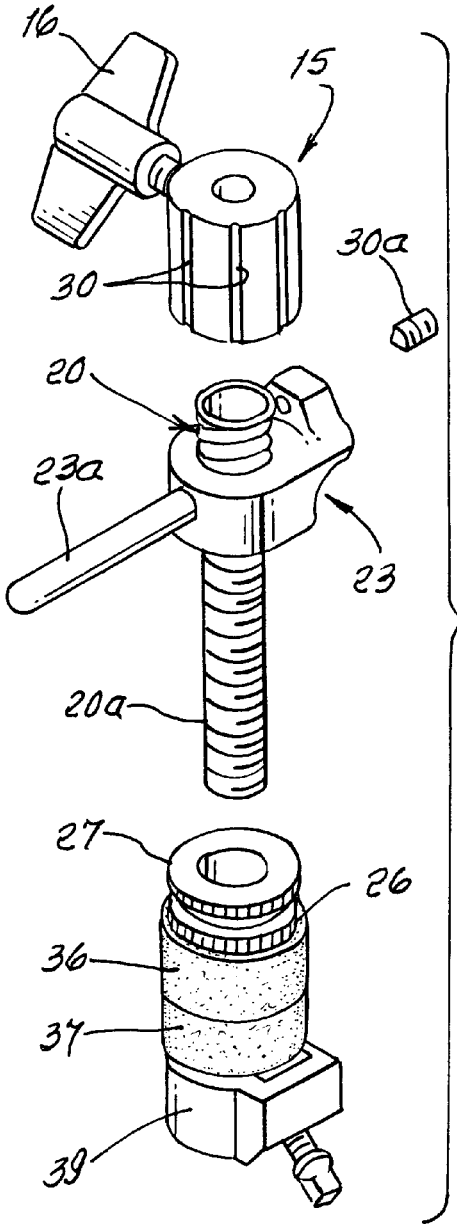
FIG. 2
FIG. 5
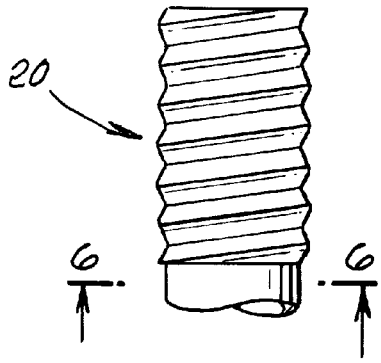
FIG. 6
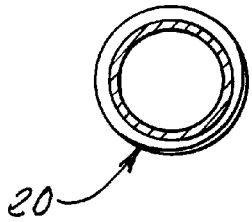

CYMBAL ADJUSTMENT AND POSITIONING FOR HI HAT

BACKGROUND OF THE INVENTION

This invention relates generally to improvements in positioning of cymbals, such as relative axial adjustment between upper and lower cymbals, and reliable retention of such adjustment.

When a set of cymbals is operated, an axially extending rod is displaced endwise so as to clash the cymbals. There is need to reliably and compactly position and hold the upper cymbals on the rod, and relative to the lower cymbals. In particular, there is need for the improvements in structure, operation and modes of operation, as are disclosed herein.

SUMMARY OF THE INVENTION

It is a major object of the invention to provide improved apparatus meeting the above needs. Basically, apparatus incorporating the invention comprises:

a) an actuator rod movable up and down, b) a tubular adjuster passing the rod, and connectible to the rod after adjustment lengthwise of the rod, c) a threaded tube passing the rod and having threaded connection to the adjuster, the tube carrying the upper cymbals, d) clutch means including a threaded body having thread connection to the tube, and rotatable thereon to be advanced on the tube to lock to the adjuster, thereby releasably locking the tube to the adjuster.

Another object includes the provision of threaded tube lower extent that projects downwardly between the clutch threaded body and the upper cymbals, there being adjustable structure connected to said lower extent to axially adjust the position of the upper cymbals.

A further object includes such adjustable structure having at least one nut that is thread connected to said tube lower extent and transmitting force between the clutch threaded body and cushioning means positioned adjacent the upper cymbals.

Yet another object includes provision of clutch means having a handle connected to said threaded body to be manually grasped and rotated relative to the body. As will be seen, the handle typically projects substantially radially outwardly relative to the threaded tube, and is located between the adjuster and the upper cymbals.

An added object includes provision of detent means to releasably retain the clutch body to said tubular adjuster at selected rotated positions of the clutch body. That detent means typically includes splines on the periphery of the adjuster, and a follower carried by the clutch body and engagable with successive splines as the clutch body is rotated.

These and other objects and advantages of the invention, as well as the details of an illustrative embodiment, will be more fully understood from the following specification and drawings, in which:

DRAWING DESCRIPTION

FIG. 2 is a perspective and exploded view of the FIG. 1 apparatus;

FIG. 5 is an enlarged external view of a portion of a threaded tube or sleeve;

FIG. 6 is an end view of the FIG. 4 tube portion, taken on lines 6-6 of FIG. 5.

DETAILED DESCRIPTION

Figures 1, 4:
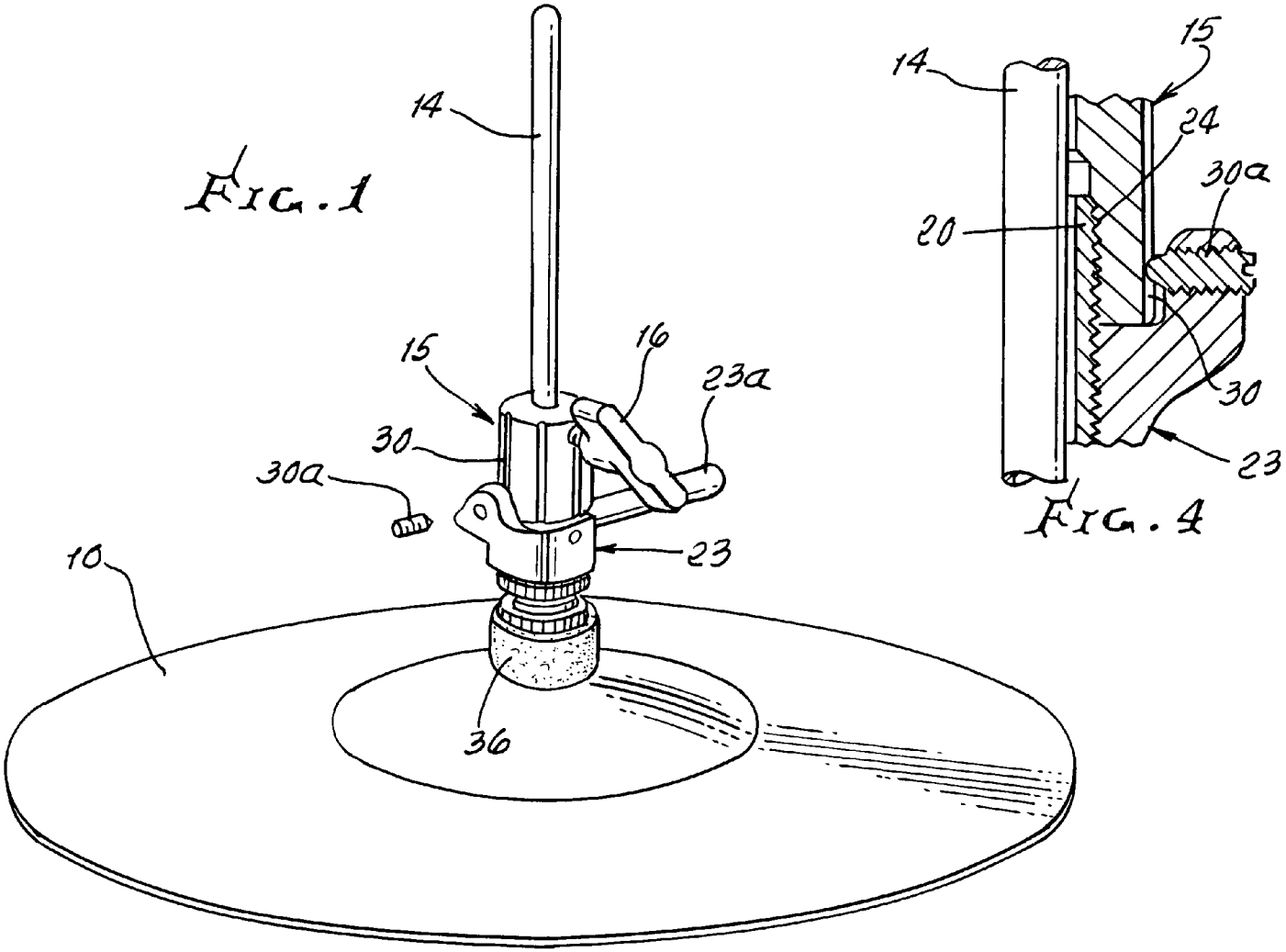
FIG. 1 is a perspective view of apparatus incorporating the invention.
FIG. 4 is a fragmentary and enlarged view of detent apparatus.
Figure 3:
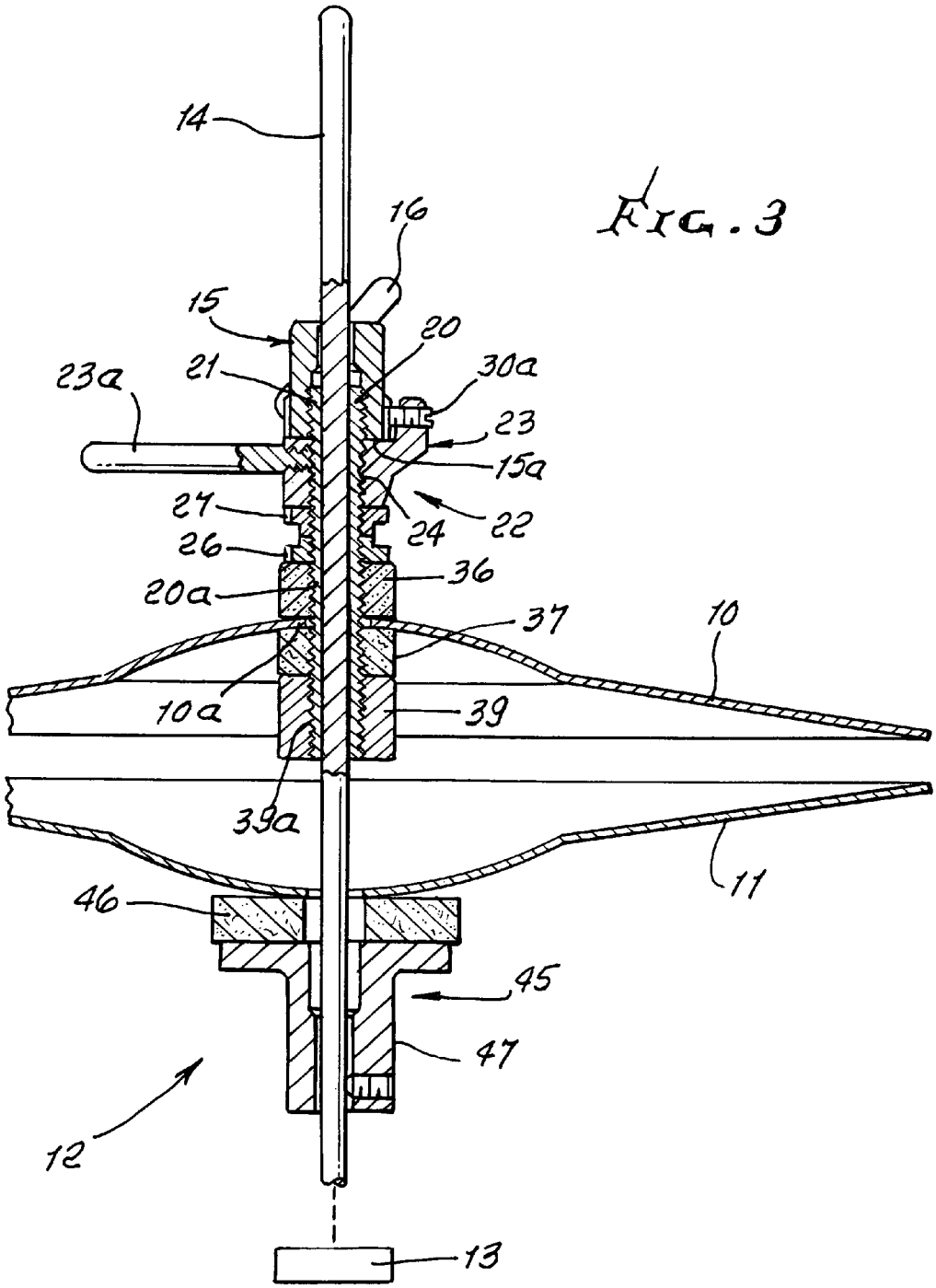
FIG. 3 is an elevation showing details.
Figure 7:
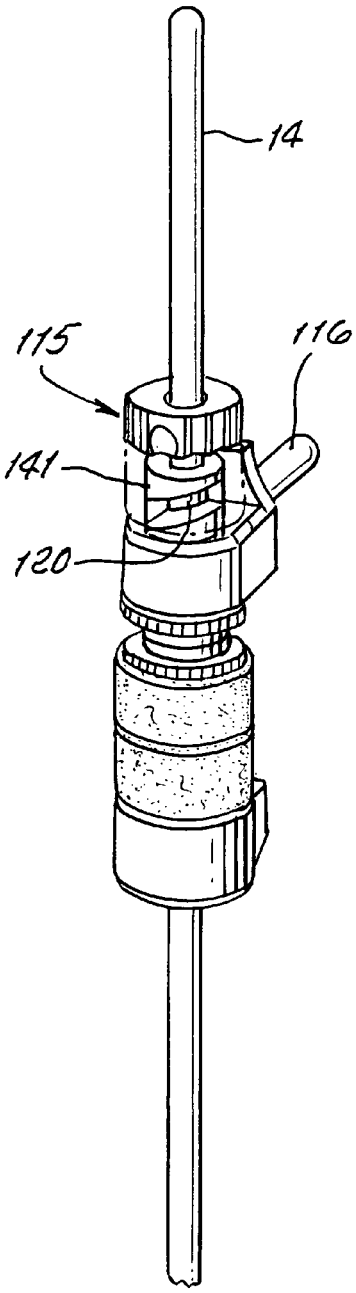
FIGS. 7-10 are views showing a modification employing a cam actuation for cymbals adjustment.
Figure 8:
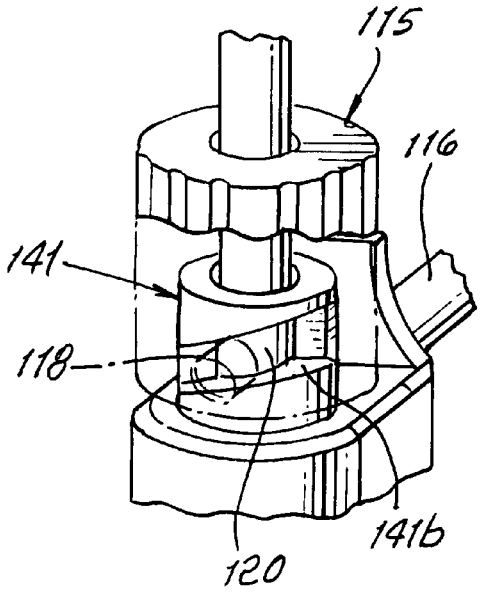
Figure 9:
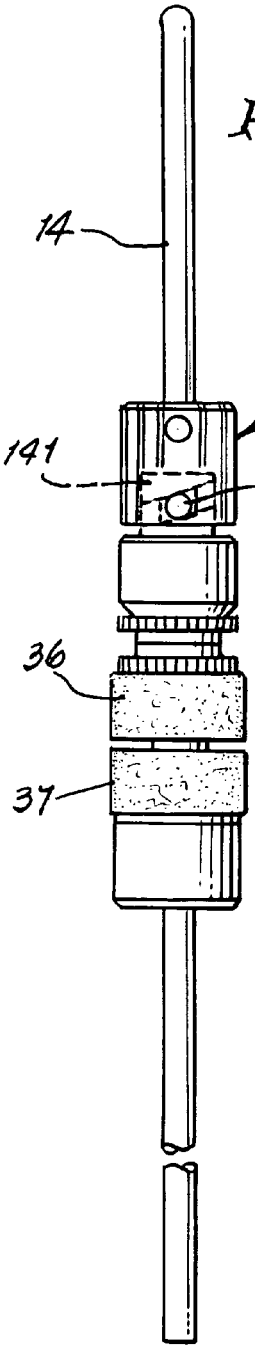
Figure 10:
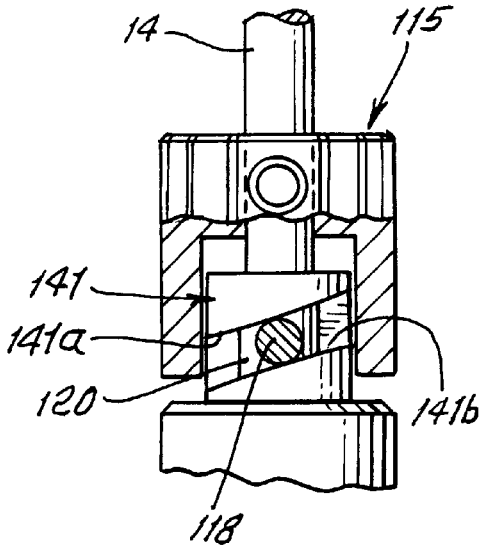

FIGS. 1 and 3 show upper and lower cymbals discs 10 and 11 carried by an upright stand 12. The upper disc is movable downwardly toward the lower disc when a foot operated pedal as in structure 13 is pushed downwardly, whereby the discs clash.

This motion is effected by downward travel of an actuator rod 14 projecting upwardly internally of the stand, and movable endwise upwardly and downwardly. See for example U.S. Pat. No. 7,276,654.

Means is provided for attaching at least one of the cymbals to said rod, to be moved by the rod relative to the other cymbals of the pair. In FIGS. 1 and 3, the upper disc 10 is moved axially, for this purpose.

As shown in the preferred device, a tubular adjuster 15 passes the rod 14, and is connectible to the rod after adjustment lengthwise of the rod to move up and down with rod 14. See for example, the wing nut 16 carried by tubular adjuster 15, and having a stem that tightens endwise against the rod 14, locking the adjuster for up and down movement with the rod.

A threaded tube or sleeve 20 passes rod 14, and has threaded interfit connection to the adjuster, at 21, whereby tube 20 can be rotated relative to the adjuster, as will be seen. Tube 20 effectively carries the upper cymbals 10, so that as rod 14 is moved downwardly, adjuster 15, tube 20, and the upper cymbals 10 are moved downwardly, to clash 10 against 11.

Clutch means indicated generally at 22, includes an internally threaded body 23, providing threaded connection as at 24 to the externally threaded tube 20. As body 23 is rotated by projecting handle **23*a*, the body 23 is advanced upwardly relative to the tube, to engage and lock to the adjuster 15, as at its underside 15*a*; and thus locks the axial position of the adjuster and arm 23*a* relative to the threaded tube 20** which carries the upper cymbals.

In this regard, detent means is preferably provided to releasably retain the clutch body and the tubular adjuster at selected rotary tightening position. In the example, the detent means includes axially extending splines or grooves 30 on the annular periphery of the adjuster. A radially inwardly extending follower **30*a* in the form of a plunger is carried by the clutch body 23 to be endwise engagable with successive splines as the clutch body is rotated. Plunger 30*a* may be tightened, to lock to 15**. This prevents inadvertent loosening of the lock-up referred to.

It will be noted that the threaded tube 20 has lower extent, as indicated at **20*a*, that projects downwardly endwise between the clutch threaded body 23 and the upper cymbals 10, there being adjustable structure connected to said lower extent to axially adjust the position of the upper cymbals. Such adjustable structure includes at least one nut 26, and preferably two nuts 26 and 27, thread connected to the tube lower extent, for transmitting force between the clutch threaded body and cushioning means 36 positioned adjacent the upper cymbals 10. This allows adjustment of annular cushions or felts 36 and 37 at the upper and lower sides of the cymbals center portion 10*a*. A retainer ring 39 is thread connected at 39*a* to the lower end of tube 20**.

Lower structure 45 positions the lower cymbals 11, on rod 14 and includes annular felt 46, and tubular seat 47.

Referring to FIGS. 7-10, they show a modification wherein the operative connection of tube 120 (corresponding to tube 20) to adjuster 115 (corresponding to adjuster 15) comprises a spiral cam 141, having a camming surface 141*a* extending annularly and in a spiral direction about the axis of tube 120. Tube 120 extends axially through the cam, as shown, and the cam is rotatable with the tube as adjuster 115 is rotated by handle 116. A cam actuator 118 projects generally radially from the adjuster into the spiral groove 141*b* defined by the cam, to bear against a cam spiral surface, to displace the cam, and the tube, axially, as the handle, i.e. actuator 118, is rotated about the tube and adjuster axis.

Of advantage is the provision, by the cam, of a lead, i.e. extent of axial displacement, generally and normally substantially greater than the lead of the screw thread connection as provided in FIGS. 1-6. This in turn allows turning of the handle 23*a* to be angularly and substantially less for the cam connection to be less than turning of the handle where the screw connection is provided, to provide the same axial displacement. Example, a full 360 degree turn of the handle around the threads would equal approximately 0.050" lift. Based on the cam the handle only needs to turn 180 degrees to give 0.200" lift. This in turn, facilitates quicker cymbals relative adjustment.

What is claimed is:

1. An adjustable assembly for cymbals adjustment, comprising in combination:

a) an actuator rod movable up and down, b) a tubular adjuster passing the rod, and connectible to the rod after adjustment lengthwise of the rod, c) a tube passing the rod and having connection to the adjuster, the tube carrying the upper cymbals, d) clutch means including a threaded body having thread connection to the tube, and rotatable thereon to be advanced on the tube to lock to the adjuster, thereby releasably locking the tube to the adjuster, e) said tube having lower extent that projects downwardly between the clutch threaded body and the upper cymbals, there being adjustable structure connected to said lower extent to axially adjust the position of the upper cymbals.

2. The combination of claim 1 wherein said tube connection to the adjuster comprises one of the following:

e) a thread connection, f) a cam connection, to be displaced up or down in response to left or right rotation of the adjuster.

3. The combination of claim 1 wherein said adjustable structure includes at least one nut thread connected to said tube lower extent and transmitting force between the clutch threaded body and cushioning means positioned adjacent the upper cymbals, said nut located directly beneath said body.

4. An adjustable assembly for cymbals adjustment, comprising in combination:

a) an actuator rod movable up and down, b) a tubular adjuster passing the rod, and connectible to the rod after adjustment lengthwise of the rod, c) a tube passing the rod and having connection to the adjuster, the tube carrying the upper cymbals, d) clutch means including a threaded body having thread connection to the tube, and rotatable thereon to be advanced on the tube to lock to the adjuster, thereby releasably locking the tube to the adjuster, e and wherein said clutch means includes a handle connected to said threaded body to be manually grasped and rotated to rotate said body.

5. An adjustable assembly for cymbals adjustment, comprising in combination:

a) an actuator rod movable up and down, b) a tubular adjuster passing the rod, and connectible to the rod after adjustment lengthwise of the rod, c) a tube passing the rod and having connection to the adjuster, the tube carrying the upper cymbals, d) clutch means including a threaded body having thread connection to the tube, and rotatable thereon to be advanced on the tube to lock to the adjuster, thereby releasably locking the tube to the adjuster, e) and including detent means to releasably retain the clutch body to said tubular adjuster at selected rotated positions of the clutch body.

6. The combination of claim 5 wherein said detent means includes splines on the periphery of the adjuster, and a follower carried by the clutch body and engagable with successive splines as the clutch body is rotated.

7. The combination of claim 3 wherein the handle projects substantially radially outwardly relative to the threaded tube, and is located between the adjuster and the upper cymbals.

* * * * *